US008417175B2

(12) United States Patent
Yamashita et al.

(10) Patent No.: US 8,417,175 B2
(45) Date of Patent: Apr. 9, 2013

(54) UNIT FOR CLEANING EDGE PORTION OF RECORDING MATERIAL OR IMAGE FORMING APPARATUS

(75) Inventors: Hidetoshi Yamashita, Machida (JP); Hisayuki Tomura, Izunokuni (JP); Kiyoharu Yoshioka, Mishima (JP); Michio Uchida, Susono (JP); Tomonori Shida, Boise, ID (US); Keisuke Mitsuhashi, Suntou-gun (JP); Takuma Abe, Mishima (JP); Takao Nada, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 942 days.

(21) Appl. No.: 12/185,923

(22) Filed: Aug. 5, 2008

(65) Prior Publication Data

US 2009/0052966 A1 Feb. 26, 2009

(30) Foreign Application Priority Data

Aug. 24, 2007 (JP) ..... 2007-217818

(51) Int. Cl.
*G03G 15/00* (2006.01)
*G03G 21/00* (2006.01)

(52) U.S. Cl.
USPC ..... 399/401; 399/98; 399/99; 399/352; 399/357; 399/390

(58) Field of Classification Search ..... 399/98, 399/99, 401, 352, 357, 390
See application file for complete search history.

(56) References Cited

U.S. PATENT DOCUMENTS

| | | | | |
|---|---|---|---|---|
| 6,564,034 | B1 | 5/2003 | Abe | |
| 7,149,455 | B2 | 12/2006 | Hattori | |
| 2007/0196147 | A1 | 8/2007 | Nada et al. | |
| 2007/0280723 | A1 * | 12/2007 | Kurosu | 399/99 |

FOREIGN PATENT DOCUMENTS

| | | | |
|---|---|---|---|
| JP | 4-66442 | A | 3/1992 |
| JP | 3009487 | U | 4/1995 |
| JP | 2000-94791 | A | 4/2000 |
| JP | 2001-261178 | A | 9/2001 |
| JP | 2002-311669 | A | 10/2002 |
| JP | 2005-41652 | A | 2/2005 |
| JP | 2005-82347 | A | 3/2005 |

(Continued)

OTHER PUBLICATIONS

Office Action dated Nov. 29, 2011, in Japanese Application No. 2007-217818.

*Primary Examiner* — Judy Nguyen
*Assistant Examiner* — Andy Pham
(74) *Attorney, Agent, or Firm* — Fitzpatrick, Cella, Harper & Scinto

(57) ABSTRACT

A toner image formed on an image bearing member is transferred onto a recording material so as to overflow from an edge portion of the recording material, thereby enabling the toner image to be formed so as to extend to the edge portion of the recording material. To suppress the deposition of the toner in the edge portion of the recording material, a cleaning member for cleaning the edge portion of the recording material obtained after the fixing is provided. In order to make a trailing edge of the recording material come into contact with the cleaning member, the recording material which has passed through a fixing apparatus is temporarily switched back, thereby allowing the trailing edge portion of the recording material to collide with the cleaning member.

7 Claims, 10 Drawing Sheets

FOREIGN PATENT DOCUMENTS

| | | | | |
|---|---|---|---|---|
| JP | 2006-1687 | A | | 1/2006 |
| JP | 2006-76753 | A | | 3/2006 |
| JP | 2006-171554 | A | | 6/2006 |
| JP | 2006171554 | A | * | 6/2006 |
| JP | 2007-8701 | A | | 1/2007 |
| JP | 2007-320667 | A | | 12/2007 |

* cited by examiner

UNIT FOR CLEANING EDGE PORTION OF RECORDING MATERIAL OR IMAGE FORMING APPARATUS

BACKGROUND OF THE INVENTION

1. Field of the Invention

The present invention relates to an image forming apparatus having a mechanism for cleaning an edge portion of a recording material.

2. Description of the Related Art

Hitherto, an image forming apparatus of an electrophotographic system makes areas where no image is formed are provided as margins in upper, lower, right, and left portions of a recording material, thereby preventing an image loss, or toner contamination in the apparatus due to an image projection that is caused by a positional precision deviation of the recording material and an image forming area.

Japanese Patent Application Laid-Open No. 2006-171554 shows an image forming apparatus for forming a marginless image that a toner image is formed up to edge portions of a recording material without providing margins. In the case of printing the marginless image, a toner image which is slightly larger than a recording material is formed onto an image bearing member such as an intermediate transfer material and the toner image on the image bearing material is transferred onto the recording material. In this manner, even if the position of the toner image on the image bearing member and the position of the recording material are slightly deviated, no margins are caused on the recording material.

However, there is a possibility that the toner in the portion overflowed from the recording material in this instance is deposited to a frame (edge portion) of the recording material.

In the image forming apparatus of the electrophotographic system, generally, the toner is fixed onto the recording material by applying a heat and a pressure to the recording material after the transfer by a fixing apparatus. However, since the heat and pressure are not efficiently transferred in the frame of the recording material, there is a case where the toner is not fixed even after the recording material passed through the fixing apparatus. There is such a problem that the toner contamination of the edge portion of the recording material after the recording material passed through the fixing apparatus is removed later, so that a circumference is contaminated by the toner.

SUMMARY OF THE INVENTION

It is an object of the invention to suppress toner contamination of an edge portion of a recording material in which a toner image has been formed up to the edge portion of the recording material.

Another object of the invention is to provide an image forming apparatus comprising: an image bearing member which bears a toner image; a transfer member which attracts the toner image from the image bearing member to a position projected from an edge portion of a recording material and transfers the toner image extending to the edge portion of the recording material onto the recording material; a fixing device which fixes the toner image transferred to the recording material onto the recording material; an ejecting port from which the recording material formed with the toner image is ejected; a switch-back mechanism which is arranged between the fixing apparatus and the ejecting port in a conveying path of the recording material and is configured to switch a conveying direction of the recording material and temporarily convey the recording material that is being conveyed toward a direction of a leading edge of the recording material toward a direction of a trailing edge; and a cleaning member configured to clean a trailing edge portion of the recording material by being come into contact with the trailing edge of the recording material that is being conveyed toward the trailing edge by the switch-back mechanism.

Further features of the present invention will become apparent from the following description of exemplary embodiments with reference to the attached drawings.

DESCRIPTION OF THE EMBODIMENTS

Exemplary embodiments of the invention will be illustratively described in detail hereinbelow with reference to the drawings. However, it should be noted that dimensions, materials, shapes, a relative layout, and the like of component parts disclosed in the following embodiments may be properly modified according to a construction and various kinds of conditions of an apparatus to which the invention is applied. Therefore, the scope of the invention is not limited to them unless otherwise specifically disclosed in particular.

First Embodiment

Figure 1:
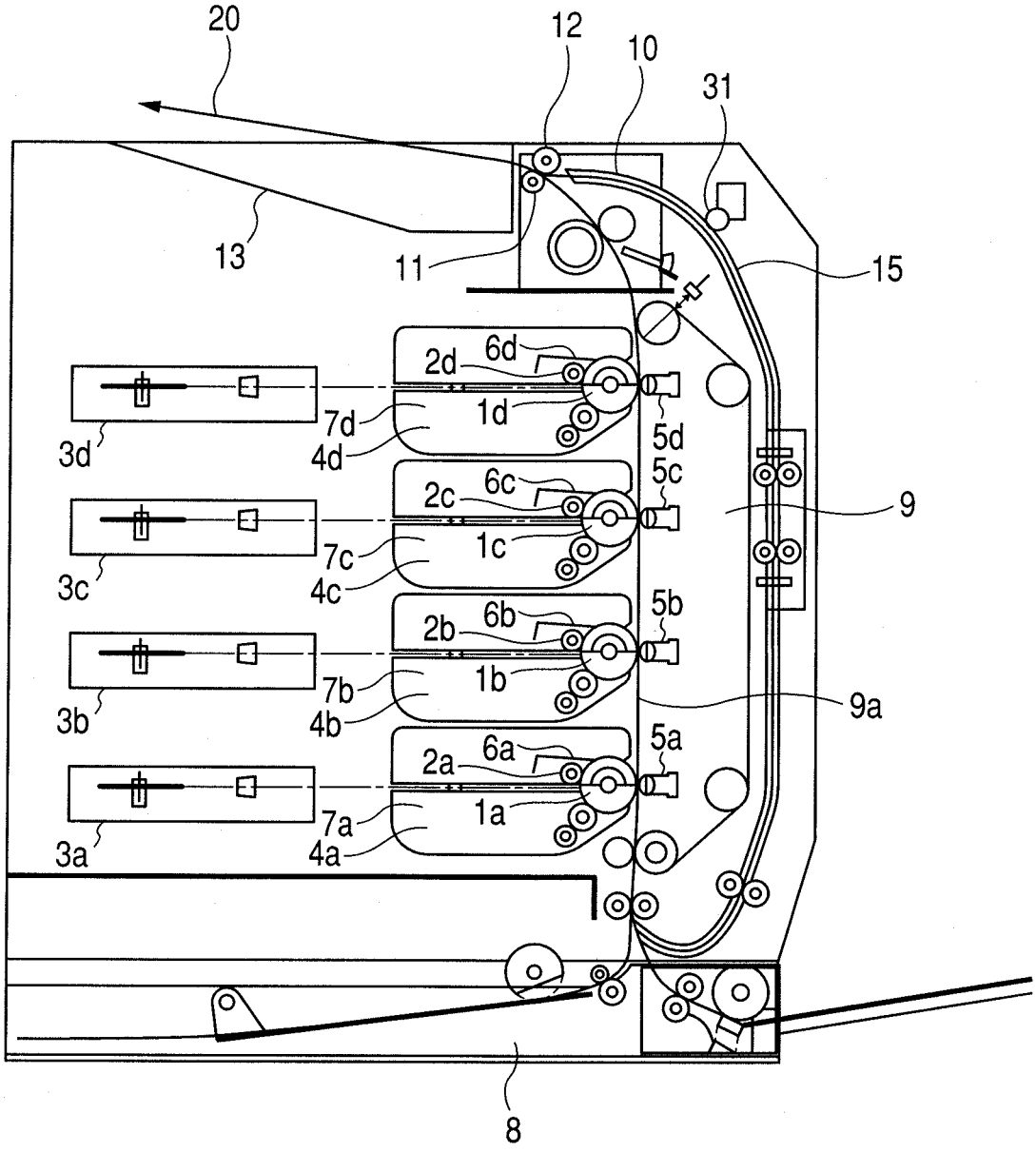
FIG. 1 is a schematic cross-sectional view of an image forming apparatus.

A schematic construction of an image forming apparatus according to the first embodiment is illustrated in FIG. 1. In the embodiment, the image forming apparatus is a color (multicolor) image forming apparatus using the electrophotographic system and is a laser beam printer which can form a full-color image of four colors. The image is formed by such an image forming step that the image visualized by toner is fixed onto a recording material by using heat.

The color image forming apparatus has a photosensitive drum 1 (1*a*, 1*b*, 1*c*, 1*d*) as a drum-type electrophotographic photosensitive material serving as an image bearing member every color (yellow, magenta, cyan, black) to be formed. Each photosensitive drum 1 is rotated, for example, counterclockwise in FIG. 1 by a driving unit (not shown).

A charging apparatus 2, an exposing apparatus 3, a developing apparatus 4, a transfer unit 5, and a cleaning apparatus 6 are arranged around the photosensitive drum 1 in its rotating direction, thereby constructing an image forming unit. The charging apparatus 2 (2*a*, 2*b*, 2*c*, 2*d*) is a charging unit for uniformly charging the surface of the photosensitive drum 1 in a charging step. The exposing apparatus 3 (3*a*, 3*b*, 3*c*, 3*d*) is a latent image forming unit (exposing unit) for allowing a light source (for example, a laser beam or an LED light) to flicker based on image information and forming an electrostatic latent image onto the photosensitive drum 1 in a latent image forming step (exposing step). The developing apparatus 4 (4*a*, 4*b*, 4*c*, 4*d*) is a developing unit for depositing the toner the electrostatic latent image on the photosensitive drum 1, visualizing (developing) the latent image, and forming a toner image in a developing step. The transfer unit 5 (5*a*, 5*b*, 5*c*, 5*d*) transfers the toner image on the photosensitive drum 1 onto the recording material in a transfer step. The cleaning apparatus 6 (6*a*, 6*b*, 6*c*, 6*d*) is a cleaning unit for removing the toner remaining on the photosensitive drum 1 after completion of the transfer.

The photosensitive drum 1 serving as an image bearing member and the charging apparatus 2, developing apparatus 4, and cleaning apparatus 6 serving as processing units which act on the drum 1 are integratedly provided as a detachable process cartridge 7 (7*a*, 7*b*, 7*c*, 7*d*) for the image forming apparatus main body.

The recording material fed from a feeding unit 8 is conveyed to the image forming unit by a conveying unit 9 having an electrostatic conveying belt 9*a*. The toner images of the respective colors are sequentially overlaid and transferred in each transfer unit in which the photosensitive drum 1 and the transfer unit 5 are opposed with each other. The toner image of each color is formed so as to be slightly larger than the recording material and is transferred so as to overflow from the recording material, so that the toner image is formed up to an edge portion of the recording material. Onto the recording material to which the toner image of each color has been transferred, the toner image is fixed by using heat and pressure applied by a fixing apparatus 10. After that, the recording material is ejected from an ejecting port by a pair of ejecting rollers 11 and 12 onto a discharge tray 13. In the diagram, an arrow 20 indicates a conveying path of the recording material.

Figure 2:
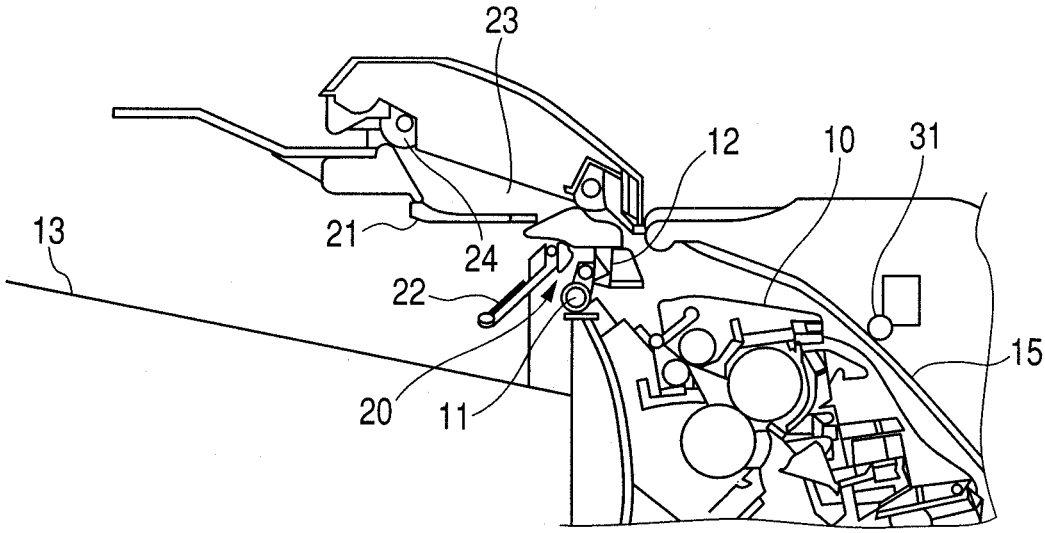
FIG. 2 is an enlarged diagram of a main section illustrating a reversing portion of a recording material.

Subsequently, the conveying path of the recording material in the case of duplex-printing the recording material will be described with reference to FIG. 2. As illustrated in FIG. 2, a direction changing member 21 as a switch-back mechanism for changing the conveying path of the recording material is arranged on the conveying path 20 for conveying the recording material from the fixing apparatus 10 to the discharge tray 13. A sensor flag 22 as a detecting member for detecting a passage of the recording material is arranged in front of the direction changing member 21. The sensor flag 22 does not obstruct the conveyance of the recording material.

In the duplex printing mode, after the recording material to which the image had been printed onto one side passed through the fixing apparatus 10, the recording material is detected by the sensor flag 22. Thus, the direction changing member 21 rotates counterclockwise, thereby guiding the recording material to a switch-back conveying path 23 only for use in a duplex step. A progressing direction of the recording material guided to the switch-back conveying path 23 is changed by reversing the rotating direction of a switch-back roller 24 as a conveying unit and the recording material is guided to a duplex conveying path 15. The recording material guided to the duplex conveying path 15 is guided again to the image forming unit through the feeding unit 8 and the conveying unit 9.

Subsequently, a path of the recording material before the recording material on which the toner image has been formed is ejected from the ejecting port will be described. In the simplex printing mode, after the recording material passes through the fixing apparatus 10, before the recording material is ejected from the ejecting port, the direction changing member 21 as a switch-back mechanism rotates counterclockwise, thereby guiding the recording material to the switch-back conveying path 23 only for use in the duplex step. The progressing direction of the recording material guided to the switch-back conveying path 23 is changed by reversing the rotating direction of the switch-back roller 24 as a conveying unit and the toner on a trailing edge side of the recording material is removed by a cleaning roller 31. After that, the switch-back roller 24 is forwardly rotated and the recording material whose trailing edge side has been cleaned is ejected from the ejecting port.

In the duplex printing mode, after the recording material to which the toner image had been transferred to the second surface passed through the fixing apparatus 10, before the recording material is ejected from the ejecting port, the trailing edge side of the recording material is conveyed toward the cleaning roller 31 by the switch-back mechanism. After the trailing edge side of the recording material was cleaned by the cleaning roller 31, the recording material is ejected from the ejecting port.

Figure 3:
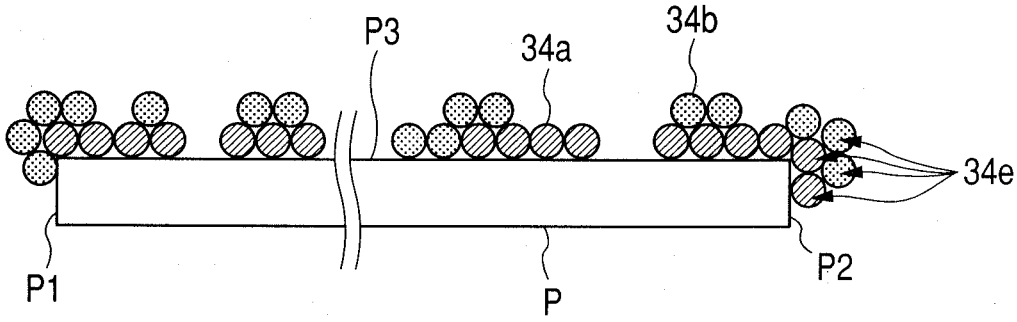
FIG. 3 is a schematic diagram illustrating a state of toner in the case where marginless printing has been performed to the recording material.

Subsequently, a cleaning member for removing the toner on a frame of the recording material will be described with reference to FIG. 3. Illustrated is an example of toner in the case of using the toner deposited so as to overflow around the frame from the recording surface of the recording material.

When the marginless printing has been performed upon printing of the first surface of the recording material, there is a case where the toner is deposited so as to overflow around the frame of the recording material. Particularly, as illustrated in FIG. 3, a large quantity of toner is deposited to edges P1 and P2 in the conveying direction of the recording material. In this instance, the direction in which the recording material is ejected from the ejecting port is used as a reference and it is now assumed that a leading edge in the conveying direction of the recording material is set to P1 and a trailing edge is set to P2. FIG. 3 is a cross-sectional schematic diagram in the case where the recording material is seen in the thickness direction. A plurality of kinds of toner 34*a* and 34*b* has been deposited on a recording surface P3 of the recording material. Toner 34*e* has been also deposited onto the edges P1 and P2 so as to overflow from the recording surface P3. As mentioned above, when the toner image is transferred onto the recording material, the toner image is transferred onto the recording material so as to overflow from the recording material. Although the toner image can be formed up to the edge portions of the recording material by such a transfer method, the toner is deposited to the edge P2 of the recording material. This is because the projected toner overflows around the edges of the recording material. Particularly, there is a case where if there is a variation in conveying speed of the recording material to the photosensitive drum 1 which bears the toner image and rotates, an amount of toner deposited to the edges P1 and P2 of the recording material increases.

With respect to the toner deposited to the edges P1 and P2 of the recording material as mentioned above, even if they are subjected to the fixing step by the fixing apparatus 10, an adhering force to the recording material is extremely smaller than that of the toner 34*a* and 34*b* fixed onto the recording surface P3. As for the fixing by the fixing apparatus 10, the toner is fixed onto the recording material by the toner which has been fused and flowed into fiber of the recording material. However, although a cross-sectional area of the recording material is small, a quantity of toner existing around the recording material is large. Therefore, there is such a situation that the toner deposited to the edges P1 and P2 drops easily from the recording material in the following case.

Figure 5:
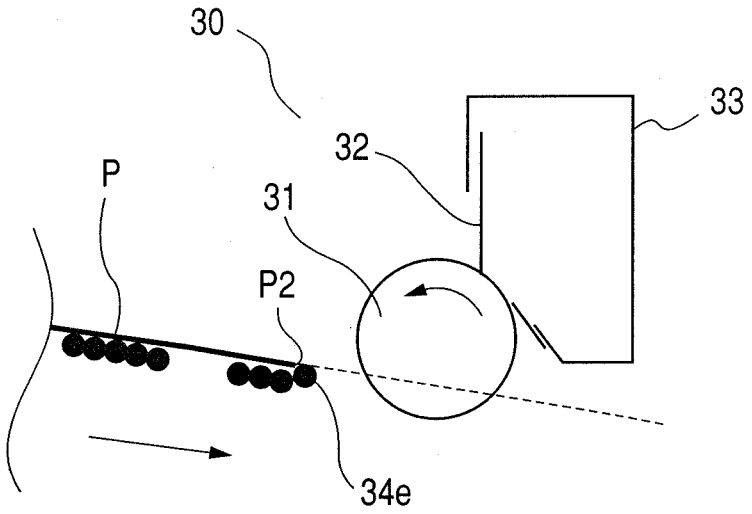
FIG. 5 is a schematic cross-sectional view illustrating the cleaning unit of the recording material.
Figure 6:
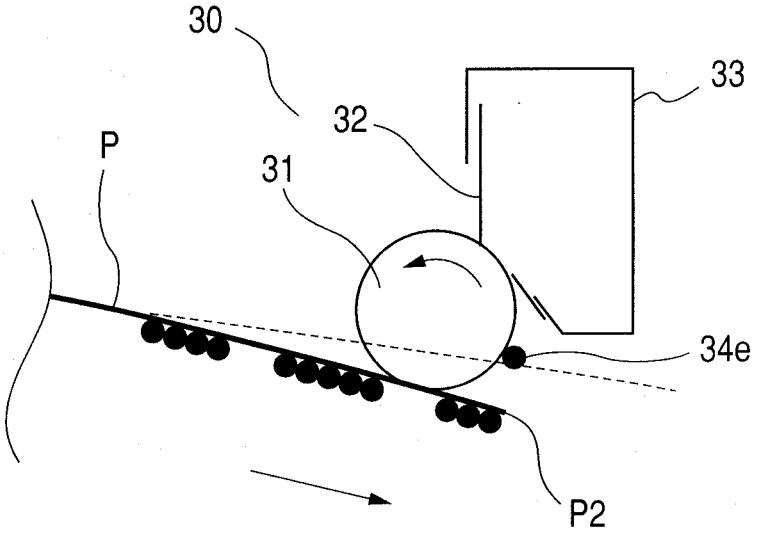
FIG. 6 is a schematic cross-sectional view illustrating the cleaning unit of the recording material.

Before the recording material is ejected from the ejecting port, if the recording material is guided to the switch-back conveying path 23 and switch-back conveyed toward the duplex conveying path 15, the trailing edge P2 as a conveying direction of the recording material during the switch-back comes into contact with the cleaning roller 31, thereby enabling the toner 34*e* to be removed. The cleaning roller 31 is provided on the upstream side of the duplex conveying path 15 as a downstream of the duplex step of the switch-back conveying path 23. As illustrated in FIG. 5, the cleaning roller 31 is provided for the conveying path 15 so that the trailing edge P2 of the recording material which has been switch-back conveyed collides with the cleaning roller 31. Therefore, when the recording material is switch-back conveyed, the trailing edge P2 of the recording material collides with the cleaning roller 31 as illustrated by a broken line in FIG. 5. FIG. 5 illustrates a state just before the recording material collides with the cleaning roller 31. By the shock at the time of the collision, as illustrated in FIG. 6, the toner 34*e* deposited to the trailing edge P2 of the recording material is removed and deposited to the cleaning roller 31. FIG. 6 illustrates a state just after the recording material collided with the cleaning roller 31, and the toner 34*e* has been moved to the cleaning roller 31. The cleaning roller 31 has been rotated in the same direction (direction shown by an arrow) as the conveying direction of the recording material. At this time, even if the cleaning roller 31 has either a construction in which it rotates or a construction in which it is driven-rotated in association with the recording material which is conveyed, the cleaning roller 31 can remove the toner from the edge of the recording material. Even in the case where the cleaning roller 31 is rotated in the direction Opposite to the conveying direction of the recording material, by setting an entry angle of the recording material to be shallower than a curvature of the cleaning roller 31, the toner on the trailing edge P2 can be effectively removed without obstructing the conveyance of the recording material.

According to the embodiment, since the toner 34*e* deposited on the trailing edge P2 of the recording material which has been switch-back conveyed is removed by the cleaning roller 31 and, thereafter, the recording material is ejected from the ejecting port, the toner of the trailing portion of the recording material which is ejected from the ejecting port can be removed.

Figure 7:
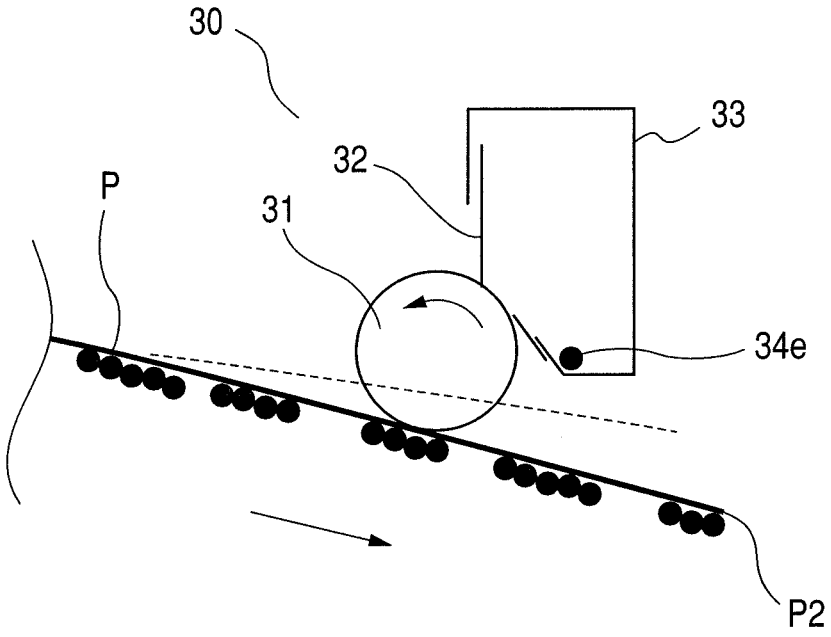
FIG. 7 is a schematic cross-sectional view illustrating the cleaning unit of the recording material.

Further, in the embodiment, since the cleaning roller 31 onto which the toner 34*e* has been deposited is rotating, a collecting unit 32 for removing the toner 34*e* from the cleaning roller 31 is provided so that the toner 34*e* is not deposited to the recording material again. The toner 34*e* on the cleaning roller 31 is removed by the collecting unit 32 and accumulated into a collecting box 33. FIG. 7 illustrates a state where the toner 34*e* deposited on the cleaning roller 31 has been removed by the collecting unit 32 and enclosed into the collecting box 33.

Second Embodiment

Figure 8:
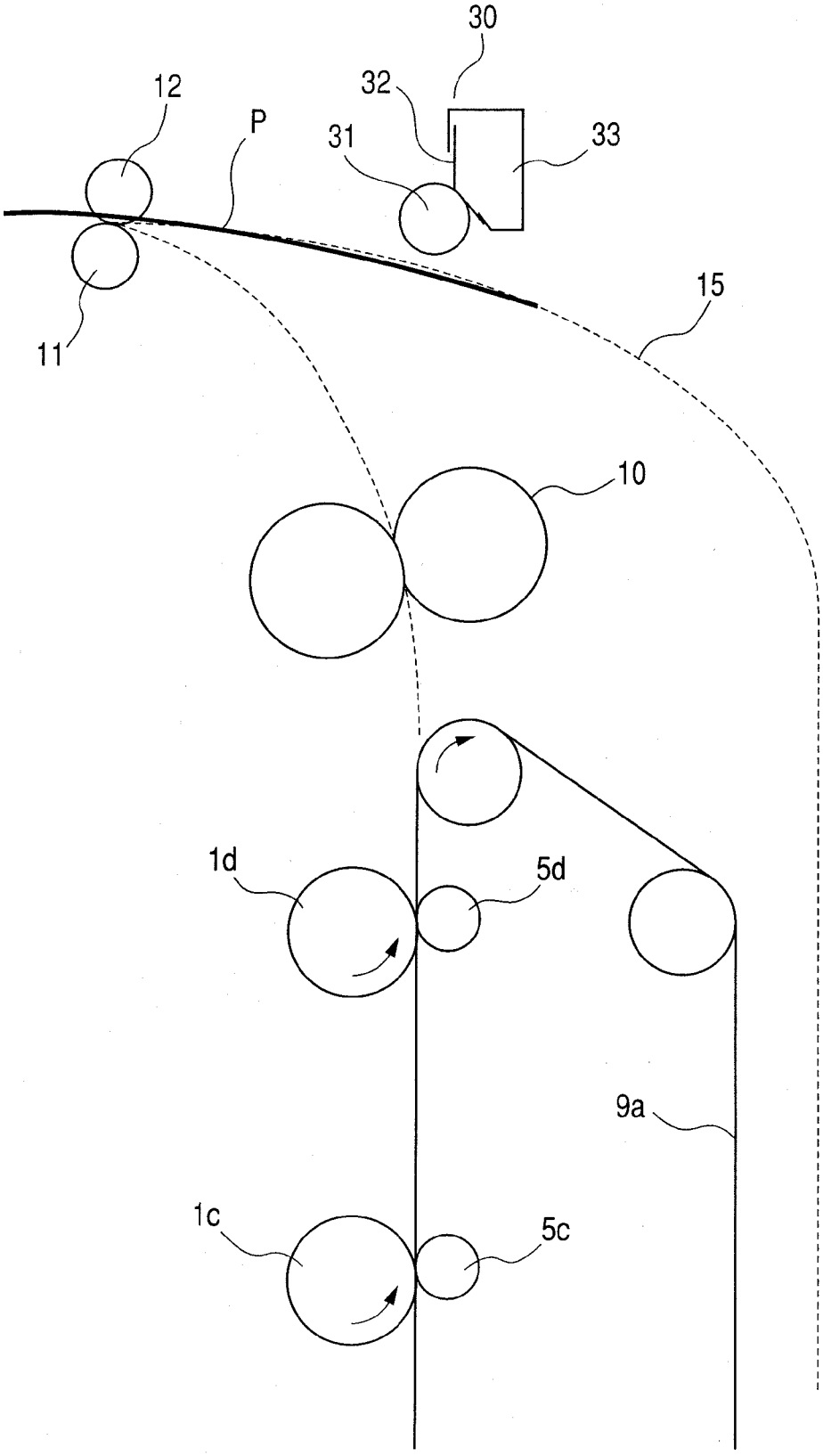
FIG. 8 is a schematic diagram illustrating a state where the cleaning unit has been retreated from a conveying path.

Although the cleaning roller 31 has been arranged on the conveying path 15 so that the trailing edge P2 of the recording material certainly collides with the cleaning roller 31 in the foregoing embodiment, the invention is not limited to such a layout. In this instance, the cleaning roller 31 can be selectively retreated from the conveying path 15. If the cleaning roller 31 is retreated from the conveying path 15 just after the trailing edge P2 of the recording material collided with the cleaning roller 31, since the cleaning roller 31 is not come into contact with portions other than the trailing edge portion of the recording material, influences on the conveyance of the recording material and the image by the cleaning roller 31 are small. That is, such a situation that the cleaning roller becomes a conveyance load of the recording material or bends the conveying path can be suppressed. FIG. 8 illustrates a state where after the recording material collided with the cleaning roller 31, the cleaning roller 31 and the like have been retreated from the conveying path 15 so as to be away from the recording material.

In the embodiment, a moving mechanism 35 for moving the cleaning roller 31 to a cleaning position (refer to FIG. 9) where the cleaning roller can come into contact with the recording material and a retreating position (refer to FIG. 10) where the cleaning roller cannot come into contact with the recording material is provided. The moving mechanism of the cleaning roller 31 will be described with reference to FIGS. 9 and 10.

A construction in which a cleaning unit 30 constructed integratedly by the cleaning roller 31, collecting unit 32, and collecting box 33 is moved by the moving mechanism 35 is illustrated here as an example.

Figure 4:
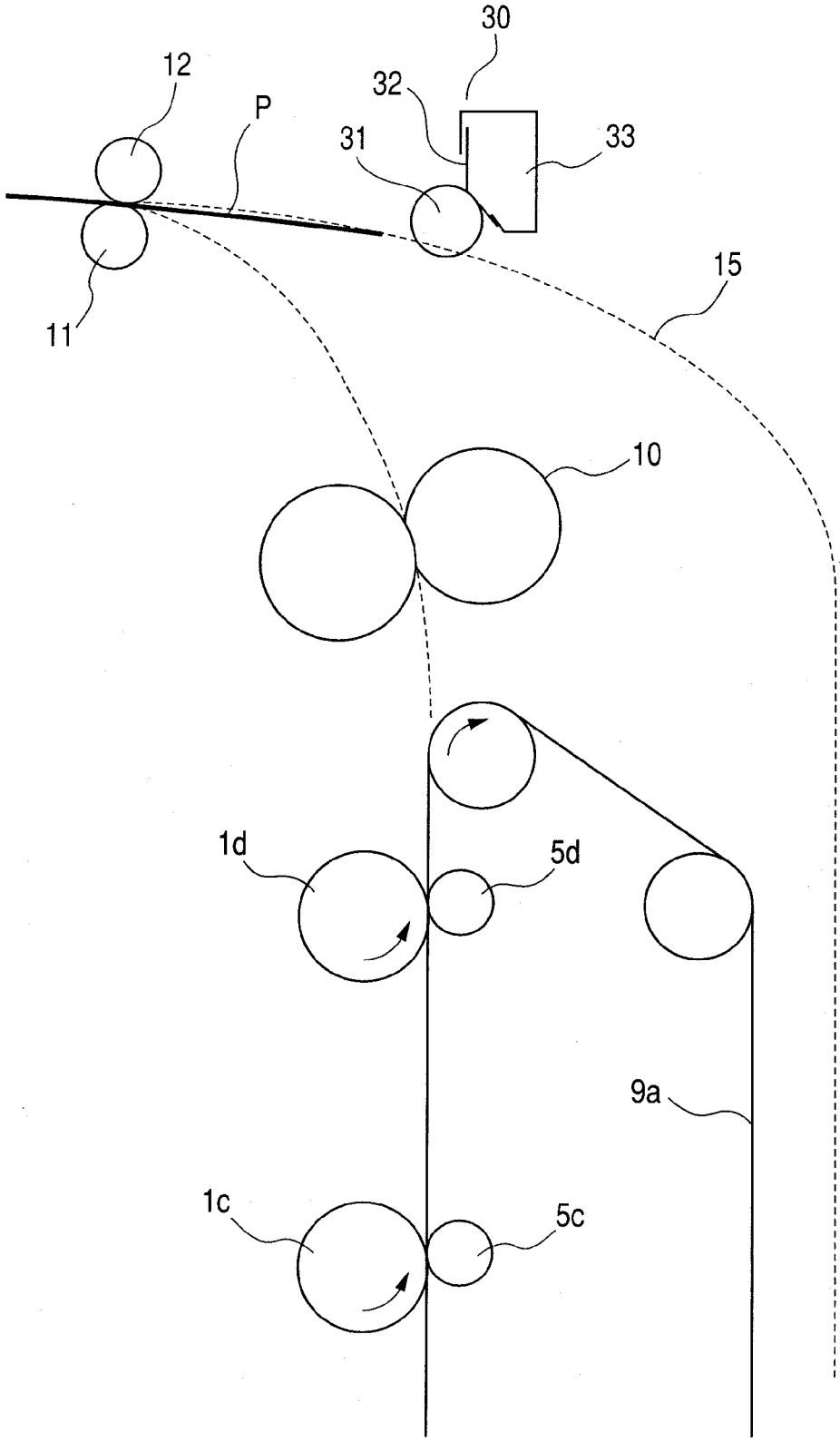
FIG. 4 is a schematic diagram illustrating a construction in which a cleaning unit is provided on a duplex conveying path.
Figure 9:
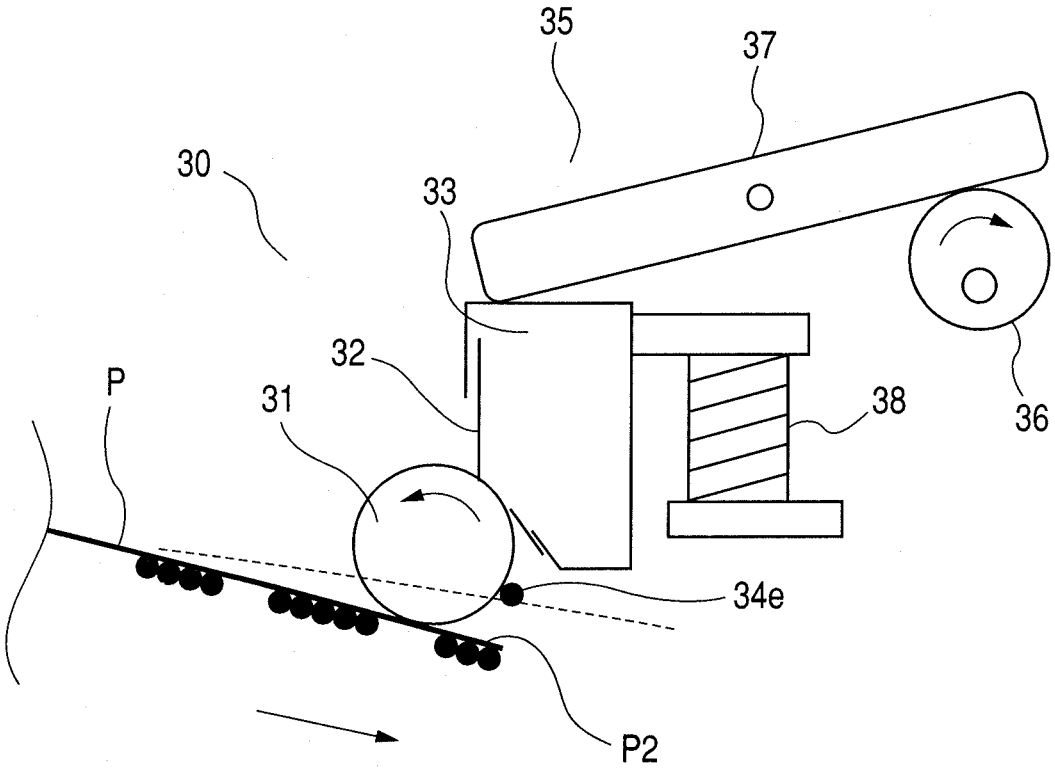
FIG. 9 is a schematic cross-sectional view illustrating a moving mechanism (cleaning position) of the cleaning unit.

According to the moving mechanism 35 of the cleaning unit 30, a connecting arm 37 is rotated by a phase of a cam 36, thereby moving the cleaning unit 30 including the cleaning roller 31 to the cleaning position and the retreating position. As illustrated in FIG. 9, when the connecting arm 37 presses the collecting box 33 against an urging force of a compression spring 38, the cleaning unit 30 including the cleaning roller 31 is moved to the cleaning position adapted to remove the toner from the trailing edge of the recording material. The cleaning position is a position where, in the conveying path 15 (refer to FIG. 4), the trailing edge of the recording material collides with the cleaning roller 31. Thus, the trailing edge of the recording material which has been switch-back conveyed collides with the cleaning roller 31 in the conveying path 15 and the toner 34*e* deposited to the trailing edge is removed.

Figure 10:
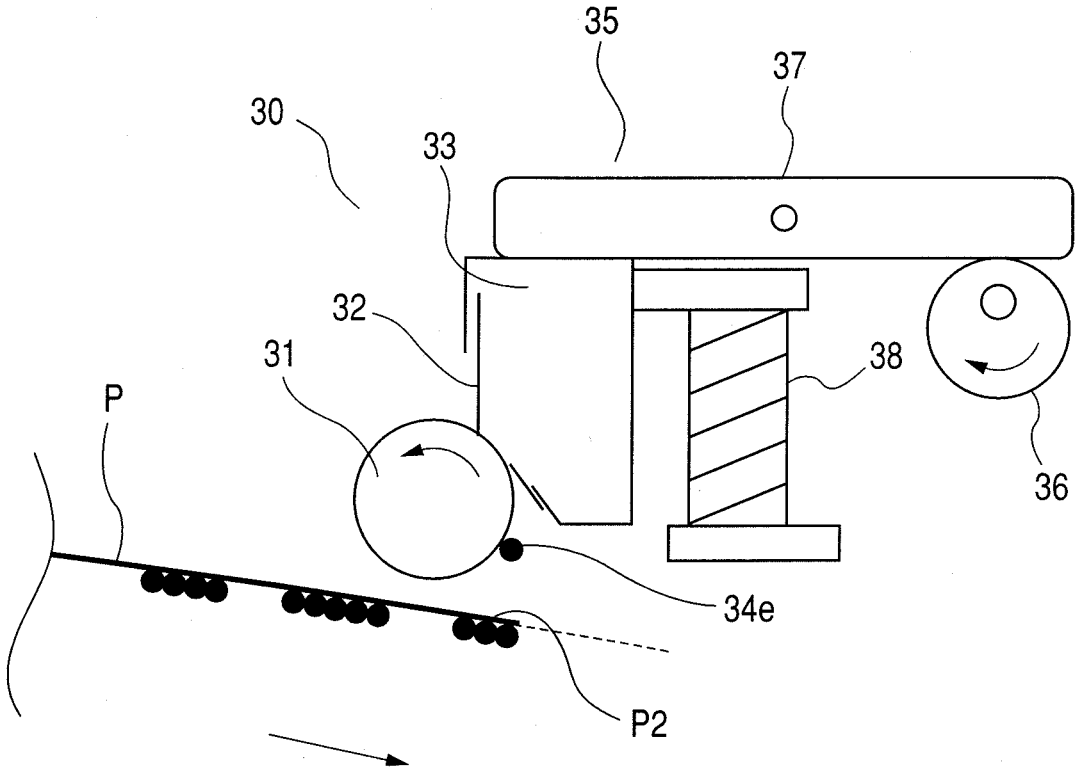
FIG. 10 is a schematic cross-sectional view illustrating the moving mechanism (retreating position) of the cleaning unit.

As illustrated in FIG. 10, when the depression of the connecting arm 37 to the collecting box 33 is cancelled by the rotation of the cam 36, the cleaning unit 30 including the cleaning roller 31 is moved by the urging force of the compression spring 38 to the retreating position where it has been retreated from the conveying path 15 (refer to FIG. 8). The retreating position is a position where the cleaning roller 31 does not come into contact with the portions other than the trailing edge portion of the recording material or a position where the cleaning roller 31 slightly comes into contact with the image surface.

By using such a construction, the cleaning roller 31 is come into contact with the trailing edge P2 of the recording material which has been switch-back conveyed, removes the toner 34*e*, and hardly comes into contact with the portions other than the trailing edge side of the recording material.

Third Embodiment

A construction in which the moving mechanism 35 of the cleaning unit 30 mentioned above does not exist and there are hardly influences on the conveyance of the recording material and the image even in a state where the recording material and the cleaning roller 31 are continuously in contact with each other is illustrated here as an example. The cleaning roller 31 is rotatable and its rotational torque (not shown) which is applied to the cleaning roller 31 until the recording material comes into contact with the cleaning roller is larger than a rotational torque which is applied to the cleaning roller 31 just after the recording material has come into contact with the cleaning roller. Specifically speaking, until the recording material comes into contact with the cleaning roller 31, the rotational torque is applied to the cleaning roller 31 so that a surface speed of the cleaning roller 31 is slower than a conveying speed of the recording material, thereby improving toner removing performance at the time when the recording material comes into contact with the cleaning roller. Just after the recording material has come into contact with the cleaning roller, the rotational torque is weakened so that the surface speed of the cleaning roller 31 is not slower than the conveying speed of the recording material. Thus, there is hardly a contact load of the cleaning roller 31 to the conveyance of the recording material and it becomes difficult that a trouble occurs to the conveyance.

Fourth Embodiment

Figure 11:
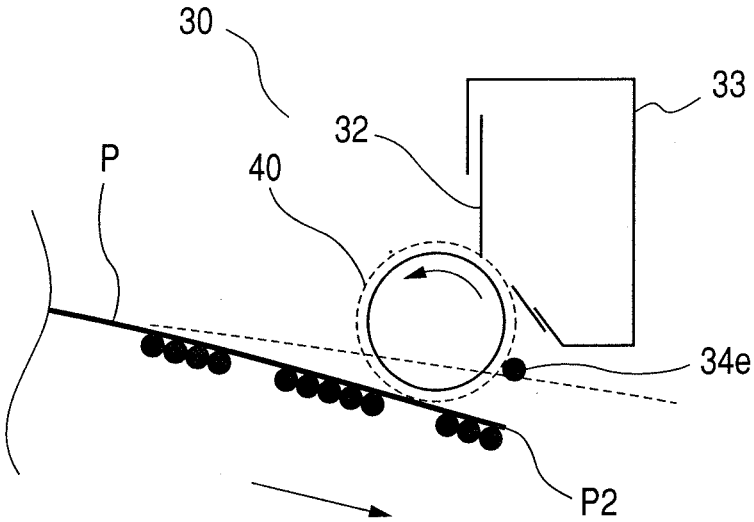
FIG. 11 is a schematic cross-sectional view illustrating a cleaning roller having a concave/convex surface.

FIG. 11 is a schematic cross-sectional view illustrating another embodiment of the cleaning roller. As illustrated in FIG. 11, as a cleaning member, a cleaning roller (rotary member) 40 which rotates in the direction shown by an arrow is provided and concave and convex portions are formed on the surface of the cleaning roller 40. Thus, an effect of removing the toner 34*e* from the trailing edge P2 of the recording material is raised. By forming the concave/convex portions onto the surface of the cleaning roller 40, a collision angle and a conveyance load of the recording material can be optimized for a toner adhering force in the edge portion.

As concave/convex portions which are provided on the surface of the cleaning roller 40, a fine groove shape may be formed on a cylindrical shape of a solid surface or the surface of the cleaning roller 40 can be also made of a foamed material such as a sponge. By using such a construction, the toner removing performance from the recording material edge is satisfied.

Fifth Embodiment

Figure 12:
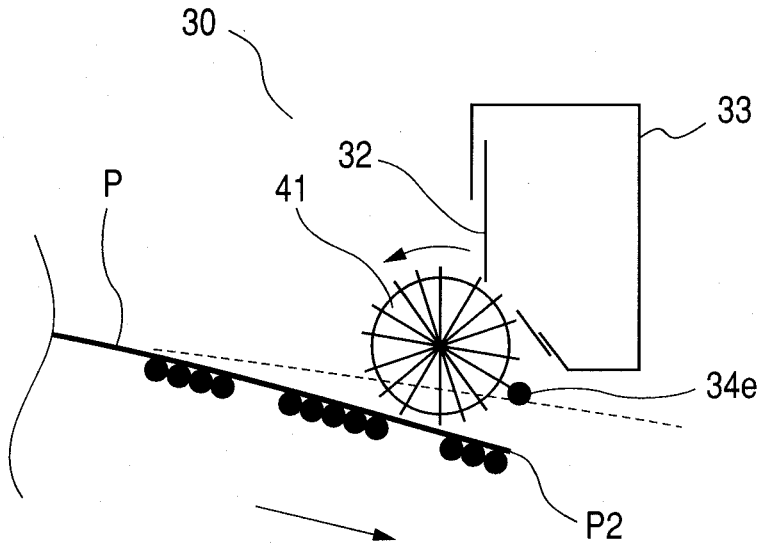
FIG. 12 is a schematic cross-sectional view illustrating a cleaning brush.

FIG. 12 is a schematic cross-sectional view illustrating still another embodiment of the cleaning member. As illustrated in FIG. 12, a cleaning brush (rotary member) 41 which rotates in the direction shown by an arrow is provided as a cleaning member. By forming the cleaning member into a brush shape as mentioned above, the effect of removing the toner 34*e* from the trailing edge of the recording material is raised. By using the brush shape, since the number of times of contact of the cleaning brush with the trailing edge of the recording material can be increased, a toner removing opportunity can be increased. By increasing a rotational speed of the cleaning brush 41, the toner removing performance is raised and can be optimized depending on the toner adhering force or the kind of recording material.

As a material of the brush shape, use of plastic fiber such as nylon, a metal brush, or the like is effective.

Sixth Embodiment

Figure 13:
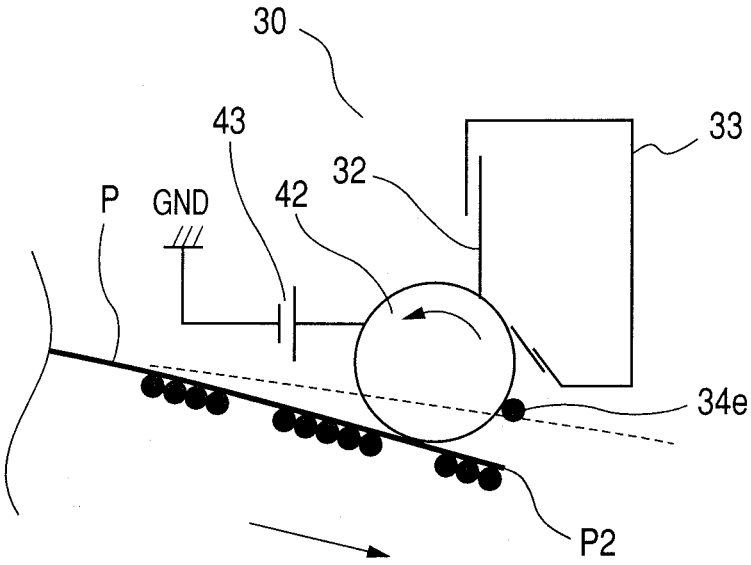
FIG. 13 is a schematic cross-sectional view illustrating a cleaning roller which can be charged.

FIG. 13 is a schematic cross-sectional view illustrating further another embodiment of the cleaning member. As illustrated in FIG. 13, a cleaning roller 42 as a cleaning member is charged by a power source 43 in order to generate a toner removing force. According to the electrophotographic system, since the toner is electrically moved and adsorbed, the toner 34*e* of the trailing edge P2 of the recording material has also been charged. An electric field bias is generated from the cleaning roller 42 to the charged toner 34*e*, thereby causing a static electricity force larger than the adhering force to the recording material. By an action of the static electricity force, the toner 34*e* of the trailing edge P2 is removed from the recording material and adsorbed and collected to the cleaning roller 42.

Other Embodiments

Although the four process cartridges are used in the foregoing embodiments, the number of process cartridges which are used is not limited to four but may be properly set to an arbitrary number as necessary.

In the foregoing embodiments, the process cartridge integratedly having the photosensitive drum and the charging unit, developing unit, and cleaning unit serving as processing units which act on the photosensitive drum has been shown as an example of the process cartridge which is detachable from the image forming apparatus main body. However, the process cartridge is not limited to such an example. A process cartridge integratedly having any one of the charging unit, developing unit, and cleaning unit besides the photosensitive drum may be used.

Further, in the foregoing embodiments, the construction in which the process cartridge including the photosensitive drum is detachable from the image forming apparatus main body has been shown as an example. However, the process cartridge is not limited to such a construction. For example, an image forming apparatus in which each of the component members has been built in or an image forming apparatus in which each of the component members is detachable may be used.

Although the printer has been illustrated as an example of the image forming apparatus in the foregoing embodiments, the invention is not limited to it. For example, another image forming apparatus such as copying apparatus, facsimile apparatus, or the like or another image forming apparatus such as a hybrid (multi-function) apparatus in which their functions are combined may be used. An image forming apparatus in which an intermediate transfer material is used, a toner image of each color is sequentially overlaid and transferred onto the intermediate transfer material, and the toner images held on the intermediate transfer material are transferred in a lump may be used. An image forming apparatus in which a plurality of developing apparatuses sequentially forms the toner images onto one photosensitive drum may be used. In this case, after the toner image formed on the photosensitive drum by one developing apparatus was sequentially overlaid and transferred onto the intermediate transfer material, toner images are transferred in a lump from the intermediate transfer material onto the recording material. Similar effects can be obtained by applying the invention to those image forming apparatuses. Effects similar to those mentioned above are also obtained not only in the case where there are no white portions on the recording material but also in the case where the toner image has been formed so as to extent to a part of the edges of the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-217818, filed Aug. 24, 2007, which is hereby incorporated by reference herein in its entirety.

What is claimed is:

1. An image forming apparatus comprising:

an image bearing member which bears a toner image;

a transfer member which transfers the toner image from the image bearing member to a recording material to be conveyed, the recording material having a first edge that is a leading edge in a first conveying direction and a second edge that is a trailing edge in the first conveying direction;

a fixing device which fixes the toner image transferred to the recording material onto the recording material;

a tray onto which the recording material on which the toner image has been fixed by the fixing device is stacked;

a roller which is provided on a downstream side of the fixing device in the first conveying direction, the roller nipping and conveying the recording material which has passed through the fixing device; and a cleaning member which cleans the second edge of the recording material, wherein, in a case in which a toner image extending to an edge portion of the recording material is formed, the roller conveys the recording material toward the cleaning member in a second conveying direction, different from the first conveying direction, while the recording material is being nipped, the cleaning member cleans the second edge of the recording material while the recording material is being nipped and conveyed by the roller, and then the roller conveys the recording material toward the tray in the first conveying direction after the cleaning member cleans the second edge of the recording material.

2. An apparatus according to claim 1, wherein the roller is a switch-back roller which conveys the recording material, which has been conveyed in the first conveying direction along a first conveying path from the fixing device toward the switch-back roller, in the second conveying direction toward a second conveying path separate from the first conveying path.

3. An apparatus according to claim 1, wherein the roller conveys the recording material while nipping the first edge of the recording material so that the second edge of the recording material abuts the cleaning member.

4. An apparatus according to claim 1, further comprising a second cleaning member configured to remove the toner from the cleaning member.

5. An apparatus according to claim 2, wherein the cleaning member is a cleaning roller which is driven to rotate by coming into contact with the second edge of the recording material.

6. An apparatus according to claim 2, wherein the cleaning member is a cleaning roller which is controlled so that a rotating speed of the cleaning roller is accelerated after the cleaning roller comes into contact with the second edge of the recording material.

7. An apparatus according to claim 1, further comprising a conveying belt, wherein the conveying belt conveys the recording material to a position where the recording material faces the image bearing member.

* * * * *